US007802511B2

(12) United States Patent
Doll et al.

(10) Patent No.: US 7,802,511 B2
(45) Date of Patent: Sep. 28, 2010

(54) SLIDE, STOP, TRIGGER DEVICE AND HANDLE FOR A WEAPON

(75) Inventors: Stefan Doll, Oberndorf/Neckar (DE); Ernst Wössner, Sulz (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 12/196,965

(22) Filed: Aug. 22, 2008

(65) Prior Publication Data

US 2009/0107024 A1 Apr. 30, 2009

Related U.S. Application Data

(60) Provisional application No. 61/030,099, filed on Feb. 20, 2008.

(30) Foreign Application Priority Data

Oct. 31, 2007 (DE) ..... 10 2007 052 105

(51) Int. Cl.
*F41A 17/42* (2006.01)

(52) U.S. Cl. ..... 89/148

(58) Field of Classification Search ..... 89/148, 89/150, 149, 154, 27.12, 137; 42/70.01, 42/70.04, 70.05
See application file for complete search history.

(56) References Cited

U.S. PATENT DOCUMENTS 949,467 A * 2/1910 Prommer ..... 89/148
1,907,163 A 5/1933 White
2,397,387 A * 3/1946 Trevaskis ..... 89/150
2,905,058 A * 9/1959 Maillard ..... 89/150
4,133,128 A * 1/1979 Brush ..... 42/70.01
4,352,317 A * 10/1982 Wilhelm ..... 89/154
5,339,721 A * 8/1994 Beretta ..... 89/142
5,913,261 A * 6/1999 Guhring et al. ..... 89/128

(Continued)

FOREIGN PATENT DOCUMENTS

DE 98 218 C 1/1896

(Continued)

OTHER PUBLICATIONS

Patent Cooperation Treaty, "International Search Report and Written Opinion," issued by the International Searching Authority in connection with international PCT application No. PCT/EP2008/009230, mailed Apr. 28, 2009, 23 pages.

(Continued)

*Primary Examiner*—Michael Carone
*Assistant Examiner*—Reginald Tillman, Jr.
(74) *Attorney, Agent, or Firm*—Hanley, Flight and Zimmerman, LLC

(57) ABSTRACT

Described herein are examples of firearms and firearm assemblies. In one example, a firearm assembly for use in a firearm including a breech block, includes safety equipment; a slide stop, wherein the slide stop is adjustable between an arresting position that locks the breech block and a position that does not lock the breech block; and a safety element adjustable relative to the slide stop between a neutral position and secured position, wherein in the secured position if the breech block exerts an operating force on the safety element and the safety element engages the safety equipment, the safety element fixes the slide stop in its arresting position.

18 Claims, 5 Drawing Sheets

U.S. PATENT DOCUMENTS

| | | | | |
|---|---|---|---|---|
| 6,125,735 | A * | 10/2000 | Guhring | 89/141 |
| 6,817,131 | B1 * | 11/2004 | Prechtl | 42/70.08 |
| 6,907,813 | B2 * | 6/2005 | Gablowski | 89/148 |
| 2004/0194615 | A1 | 10/2004 | Gablowski | |

FOREIGN PATENT DOCUMENTS

| | | | |
|---|---|---|---|
| DE | 10 09 978 | B | 6/1957 |
| DE | 11 29 871 | B | 5/1962 |
| DE | 14 53 917 | A | 9/1969 |
| DE | 10163003 | | 7/2003 |
| WO | 2009056349 | A2 | 5/2009 |

OTHER PUBLICATIONS

Patent Cooperation Treaty, "International Preliminary Report on Patentability," issued by the International Searching Authority in connection with international PCT application No. PCT/EP2008/009230, mailed Nov. 11, 2009, 18 pages.

Patent Cooperation Treaty, "International Search Report," issued by the International Searching Authority in connection with international counterpart PCT application No. PCT/EP2008/001365, mailed Aug. 27, 2008, 6 pages.

Patent Cooperation Treaty, "International Preliminary Report on Patentability," issued by the International Searching Authority in connection with international counterpart PCT application No. PCT/EP2008/001365, mailed Nov. 13, 2009, 30 pages.

Patent Cooperation Treaty, "Written Opinion," issued by the International Searching Authority in connection with international counterpart PCT application No. PCT/EP2008/001365, mailed Nov. 13, 2009, 6 pages.

* cited by examiner

SLIDE, STOP, TRIGGER DEVICE AND HANDLE FOR A WEAPON

CROSS REFERENCE TO RELATED APPLICATIONS

This application claims the benefit of U.S. Provisional Application No. 61/030,099, filed Feb. 20, 2008, the entire content of which is hereby expressly incorporated herein by reference. Additionally, this case claims priority to German patent application DE 10 2007 052 105, filed Oct. 31, 2007, the entire content of which is expressly incorporated herein by reference.

TECHNICAL FIELD

The present disclosure pertains generally to firearms and, more particularly, to a slide stop, a trigger device, and a handle for a weapon. In some examples, the weapon may be an automatic weapon having a breech block and safety equipment at which the slide stop can be adjusted between an arresting position which locks the breech and a position that does not lock the breech block.

BACKGROUND

Automatic weapons, such as machine guns or submachine guns, which are constructed for continuous fire, have a relatively simple trigger mechanism, which is subsequently described in conjunction with FIGS. 8 and 9.

Under the moving range of the breech block (not shown in FIGS. 8 and 9) there is a handle in which a trigger (a) is swivel-mounted. The lateral swivel axis of the trigger is located in the upper midrange of the trigger so that, when the trigger is pulled, the rear upper part of the trigger covers a cam track. The rear upper part of the trigger impacts the front part of a slide stop (f) which, in turn, is swivel-mounted around a lateral axis and attached in the weapon housing or in the handle. The rear part of the slide stop (f) is designed as a sear arm or sear arms. If a spring swivels the trigger (a) forward into neutral position, because of the spring load, the front part of the slide stop (f) swivels downward and the rear part together with the sear arm (s) swivels upward. This position of the sear arm is the arresting position (see FIG. 8). Trigger (a) and slide stop (f) respectively can be absorbed or preloaded by its own or a mutual spring, which pushes them into neutral position (trigger) or arresting position (slide stop).

If now the breech block is pulled back from its frontal neutral position, it moves with its underside the sear arm (s) and, consequently, the rear part of the slide stop (f) downward while moving above the sear arm (s). If a sear catch assembled at the underside of the breech block has moved above the sear arm (s), it snaps upward, being positioned behind the sear catch. The weapon is now loaded and ready to fire.

If the trigger (a) is pulled, the sear arm(s) is lowered until it releases the sear catch; the breech block is released and the weapon starts firing continuously. If the trigger (a) is released, the sear arm moves again springs back into its arresting position, being positioned behind the sear catch and keeping the breech block in a position ready to fire (rear position). Thus, continuous fire is interrupted.

Frequently, the breech mechanism consists of a safety catch that prevents unintentional pulling of the trigger. However, it does not prevent the sear arm from being released as a result of accelerating forces if, for example, the loaded, cocked and safety-engaged machine gun falls from a truck.

Therefore, there are breeches (w) which additionally or alone fix the slide stop (f) in its arresting position at a safety finger. However, this involves the disadvantage that, if the weapon is secured, the breech block cannot be pulled above the arrested slide stop (f), or that it can be jammed on the slide stop (f) because the slide stop cannot give way. FIG. 8 shows a safety barrel (w) which supports by means of its peripheral surface a safety finger (i) of the slide stop (f). A weapon having such a breech (w) cannot be fully loaded while the weapon is in secured position.

Fully automatic weapons operating according to the functional principle described above are increasingly used in so-called weapon stations. In these stations, mounted weapons are aligned by means of a remote controlled actuator and operated by means of actuators impacting the trigger and safety equipment. The actuators may be, for example, electromagnetic. In order to guarantee the highest possible degree of safety, these actuators are designed in such a way that trigger activation is interrupted in case of dysfunctions (for example, power failure) and that, independent of the condition of the weapon, the safety equipment is adjusted to "safe."

Besides the problem described above of there being no possibility to fully load the secured weapon, another dysfunction can occur in that the weapon continues to fire uncontrollably despite interrupted trigger activation. Extreme operating forces of the actuator can result in the fact that the breech block jams the safety finger (i) in the slide stop (f) to such an extent that the sear arm (s) remains at the breech block without engaging in the sear catch. This dysfunction can occur if the breech block moves forward immediately after trigger activation and power failure results in the fact that simultaneously the trigger is released and the actuator, which impacts the breech block, pushes it into its "safety" position. In this condition of the weapon, the slide stop (f) and sear arm (s) are in release position, and the safety finger (i) connects to the safety recess at the safety equipment (i) (here: safety barrel (w)). If now the actuator moves the safety barrel (w) in the direction of "safe," the safety finger (i) blocks its adjustment travel and possibly the side of the safety recess pushes so tightly against the safety finger (i) that the slide stop (f) despite being spring-loaded cannot move into its arresting position. The slide stop (f) is jammed above the safety finger (i) and the breech block moves back and forth, firing without interruption, until ammunition supply is interrupted (see FIG. 9).

In view on this problematic situation there are trigger devices in which the sear arm is assembled at a catch jack that is swivel-mounted to a catch lever (see, for example, DE 101 63 003 A1 and US 2004/0194615 A1 or U.S. Pat. No. 6,907, 813 B2). In the case of retracting travel of the breech block, said catch jack is swiveled against spring load from its arresting position into standby position in which the breech block can move over the catch jack. In the case of forward travel of the breech block, under the influence of a spring, the sear arm of the catch jack engages in the sear catch and is held in this arresting position by the breech. The catch jack is also equipped with a safety element that interacts with the safety equipment (for example, a safety barrel) in such a way that they can be always returned into their secured position, regardless of the position of the breech or catch lever. At the same time, the safety equipment can impact the trigger as well as the catch lever.

This particular trigger device requires an additional spring element in order to secure the catch function, and the catch jack and its swivel attachment must carry the full force of the forward traveling breech. In the process, the comparatively small catch jack and its attachment are placed under extreme dynamic stress. In worst case scenario, a possible crack or malfunction of the catch jack, its attachment in the catch lever and/or spring element have such an effect on the function of the weapon that the weapon, independent of the position of the safety device and trigger, continues to fire until the entire supply of ammunition has been fired. Moreover, the operating force of the spring element has to be precisely adjusted to the spring-load impacting the catch lever. Otherwise, the breech block moving over the catch jack also pushes the catch lever downward into the handle. This can possibly seriously affect the interaction between the safety element and safety barrel.

DETAILED DESCRIPTION

Position specifications such as "top," "bottom," "left," "right," "front," and "back" apply from the perspective of the shooter to a weapon in normal aiming position, firing horizontally to the "front."

Figure 1:
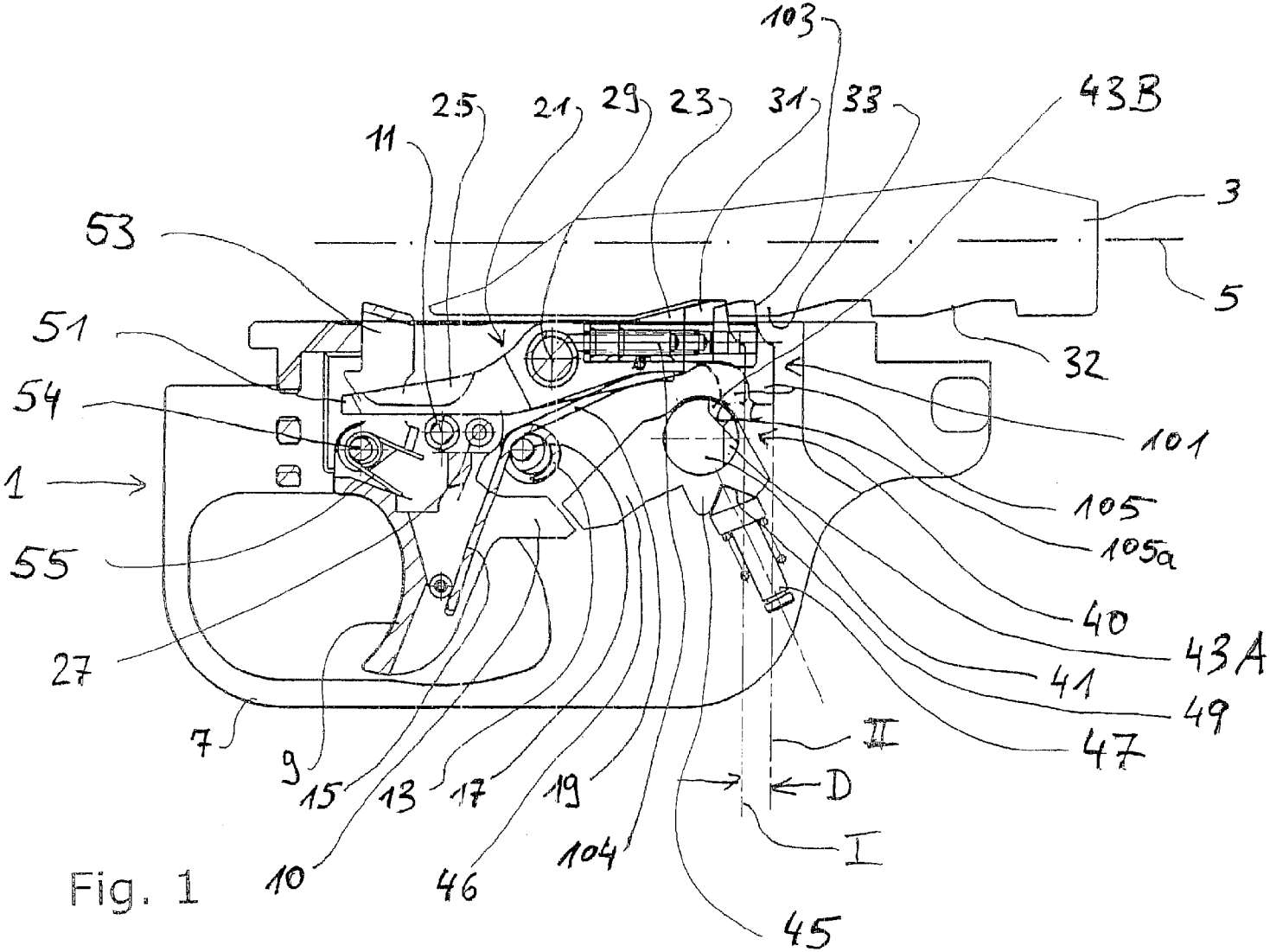
FIG. 1 a lateral view of a handle (partially opened) having an example of the invention-based trigger device in which the safety element is designed in the form of a slide.

Assembly and function of the described slide stop 21 or trigger device are explained below in conjunction with two examples. A first example is shown in FIG. 1 and a second example is shown in FIGS. 2 through 7. Similar reference numbers apply to the similar components. Of course various implementations may vary from the two examples described herein without departing from the spirit and scope of the invention.

According to the example of FIG. 1, a handle 1 is attached to a housing (not shown) of a weapon in which a moving range for a partially shown breech block 3 is defined. The moving range of the breech block runs along a bore axis 5.

On its front side, the handle has a trigger bracket 7 to which a trigger 9 connects and which comes from above out of the handle 1. The trigger 9 is swivel-mounted to a trigger axis 11, which runs laterally to the bore axis 5, in the handle 1. A leg spring 13 having two legs surrounding a cross pin 17 by means of which they are fixed to the handle 1 pushes the trigger 9 forward with its lower spring leg 15. The upper spring leg 19 pushes a two-armed slide stop 21 engaging to its rear lever arm 23 counterclockwise upward into an arresting position. The frontal lever arm 25 runs above the trigger axis 11 and a release reel 27 attached to the trigger 9. The slide stop 21 is swivel-mounted to a lever axis 29 in the handle 1 running lateral to the bore axis 5.

Figure 4:
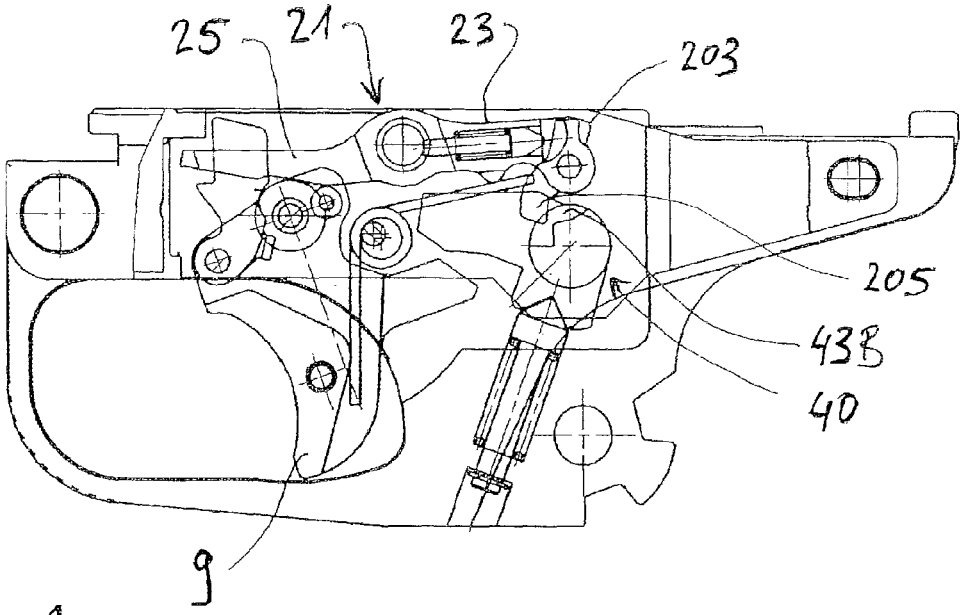
FIG. 4 the trigger device of FIG. 2 in which the breech block is released, the trigger is activated and the safety equipment is in "firing" position B.

If the trigger 9 is activated and swiveled counterclockwise against the force of the leg spring 13, the release reel 27 raises the frontal lever arm 25 against the force of the leg spring 13 and lowers the rear part of the rear lever arm 25 (this position is shown in FIG. 4 in connection with the second embodiment). At the rear part of the rear lever arm 23, a sear arm 31 is shown which is positioned in front of (before) a sear catch 33 at the breech block 3, keeping it in cocked position, ready to fire (FIG. 1). During the process of lowering the sear arm 31 by activating the trigger, the breech block 3 is released, moving forward in the weapon housing under the impact of the breech block spring (not shown), feeding ammunition and finally firing (by means of the firing pin—not shown) the propellant (see position in FIG. 4).

During the process of lowering the rear part 23 of the slide stop 21, its front part 21 is raised. At a safety catch 51 provided there said slide stop is pushed up by a release lever 53. The release lever 53 is suspended at the trigger 9, swiveling around a pin 54 against the force of a catch spring 55. After releasing the trigger, the release lever 53 keeps the rear part 23 and the sear arm 31 of the slide stop 21 outside of the moving range of the breech block (position as in FIG. 5).

Figure 6:
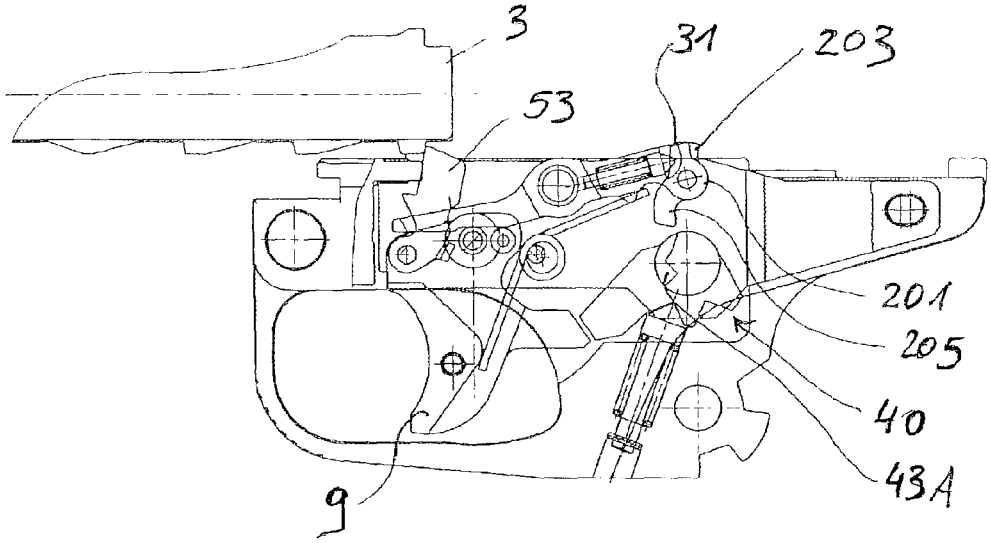
FIG. 6 the trigger device from FIG. 5 in which the retracting breech block placed the slide stop in arresting position by activating the release lever.
Figure 7:
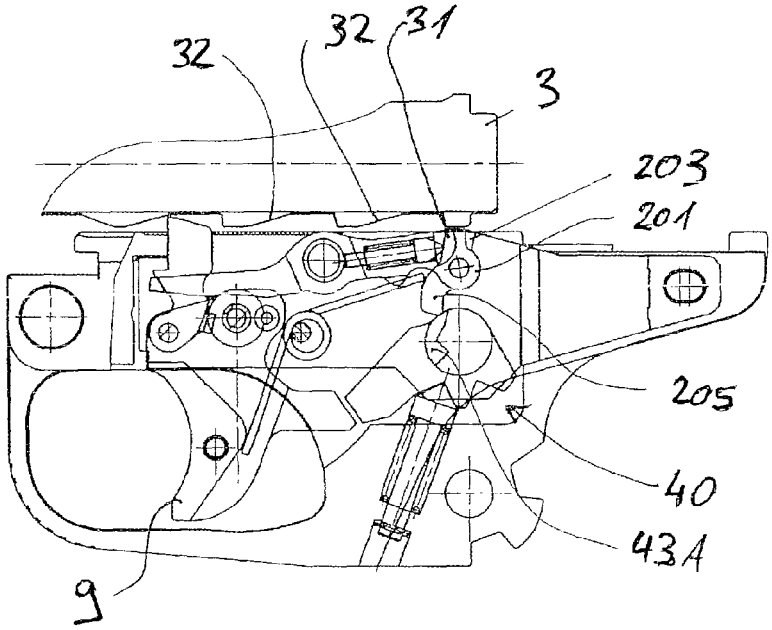
FIG. 7 the breech arrangement from FIG. 6 in which the further retracting breech block has offset the slide stop from its arresting position at the sear arm, and in which the safety equipment is in "secured" position A.

Only after the breech block 3 runs backwards, it strikes the release lever 53 and deviates it clockwise against the force of the catch spring 55, releasing the safety catch 51 at the slide stop 21 which jumps with its rear part 23 counterclockwise into the moving range of the breech block 3 (see FIG. 6). At the same time, one after another, the sear catch 33, or sear catches, of the breech block 3 move over the sear arm 31 which resiliently connects to the handle below (see FIG. 7) until the front sear catch 33 at the breech block 3 completely moved over the sear arm 31, the slide stop 21 accepted its arresting position and the sear arm 31 encloses the sear catch 33, applying a force in forward direction, and keeps the breech block 3 in the backmost position.

At the trigger device of the first example (FIG. 1), at the rear part of the rear lever arm 23 a slide 101 has been arranged, forming an actuator with its rear face surface 103, allowing the adjacent sear catch 33 to engage. In neutral position (II), the slide 101 comes under the influence of a spring arrangement 104 running in the interior of the rear lever arm 23, by the value D towards the back from the rear lever arm 23.

The sear catch 33 of the breech block 3 pressing from behind against the rear face surface 103 of the slide 101 displaces the slide 101 against the effect of the spring arrangement 104 approximately in the direction of the bore axis 5 by the value D into the rear lever arm 23 in the secured position I of the slide. In this position, the rear face surface 103 of the slide attaches to the rear face surface of the sear arm 31 is completely situated inside the sear arm profile. In the process, the rear face surface of the sear arm 31 prevents the breech block 3 from moving further forward if the sear arm 31 is in arresting position (see FIGS. 1, 2 and 3). At the same time, it is guaranteed that the slide 101 is only insignificantly exposed to the stress of forward traveling and snuggly fitting breech block 3. The stress of the slide 101 results only from the reset force of the spring arrangement 104 that the forward traveling breech block 3 has to overpower. However, the sear arm 31 or slide stop 21 are exposed to most of the stress. This minimizes the risk of overstress and malfunction of the slide 101.

The slide 101 has a finger 105 coming from the actuator (here: its rear face surface 103), and running downward. The finger 105 forms a locking element and interacts with safety equipment 40. The safety equipment 40 shown consists of a safety barrel 41 that is equipped with a recess 43. A notch plate 45 and an adjusting lever protruding from the housing (not shown) are torque-proof connected to the safety barrel 41 over which the safety barrel is turned between "secured" position and firing position. These two positions are defined by two recesses 49 at the notch plate 45 and one fixed resilient catch arrangement 47, each of which engage in one of the two recesses 49.

The notch plate also has a safety flag 46. If the safety equipment is in its "secured" position (the position in FIG. 1), a respective safety appendage 10 is positioned behind the safety flag 46. The safety appendage 10 extends from the trigger 9 backwards into the housing 1.

The slide 101 interacts via the finger 105 with the safety equipment in the following way:

If a weapon is fully loaded, the breech block 3 and its sear catch 33 rest against the rear face surface of the sear arm 31 and the rear face surface 103 of the slide 101, which adopts secured position (position I). Here the finger 105 is in the effective range of the safety equipment 40. The recess 43 in the safety barrel 41 is in a secured position (position A). An active surface 105*a* of the finger 105 rests against the outer peripheral surface of the safety barrel 41. As a result, the slide 101 supports the rear lever arm 23 and, consequently, the sear arm 31 downward against the safety barrel 41. The sear arm 31 cannot be removed from its arresting position; not even if the additional safety catch, which is formed by the safety flag 46 and the safety appendage, were eliminated and the trigger 9 activated.

If the safety equipment 40 is placed into "firing" position by turning the safety barrel 41, the recess 43 accepts position B and is located in the area of the finger 105. At the same time, the safety flag 46 accepts a position outside of the effective range of the safety appendage 10 (not shown in FIG. 1, see analogous FIG. 3).

If the trigger 9 is activated, the frontal lever arm 25 of the slide stop 21 is pushed clockwise upwards via the release reel 27, and the lower lever arm 23 having the sear arm 31 and the slide 101 is deviated downward into the housing 1. At the same time, the finger 105 enters the recess 43 in the safety barrel 41, the breech block 3 is released and moves forward (see analogous FIG. 4).

Figure 5:
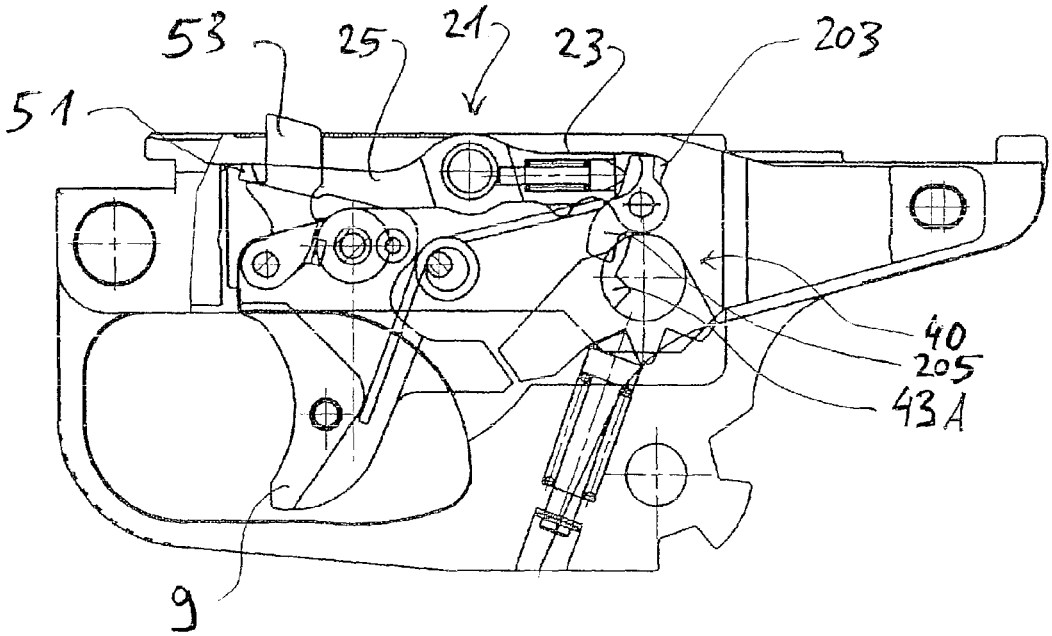
FIG. 5 the trigger device from FIG. 4 in which the trigger is released, the release lever is locked by the slide stop, and the safety equipment is in "secure" position A.

In the process, the frontal lever arm 25 having the safety catch 51 is caught in the release lever 53, so that the slide stop having the sear arm 31 remains inside the handle 1 if the trigger 9 is enabled (this position is shown analogous in FIG. 5).

The slide 101 accepts neutral position in which its rear face surface 103 protrudes out of the rear part of the sear arm 31 and the finger 105 runs outside of the effective range of the safety equipment 40 (position II, shown in FIG. 1 by a solid line).

During normal function of the weapon, the forward moving breech block 3 loads a new cartridge. Subsequently, through the repercussion resulting from firing, the breech block is again thrown backwards and releases the release lever 53, which, in turn, releases the safety catch 51. Thus, under the effect of the upper spring leg 19 of the leg spring 13, the slide stop 21 including its rear lever arm 23 moves upward. At the same time, the retracting breech block 3 displaces the rear lever arm 23 downward, namely via appropriately designed leading angles 32 which run, for instance, at an angle from the edge of the sear catch 33 to the rear upper area. In the process, the breech block spring is cocked until the movement of the breech block 3 reverses and the sear catches 33 attach to the rear face surface of the sear arm 31. At the same time, the rear face surface 103 of the slide 101 is moved forward into the rear lever arm 23.

In the case of malfunction (misfire, dysfunction during forward travel of the breech block, etc.) the breech block 3 does not move back but remains between trigger arrangement and cartridge storage. Even in this case, the safety equipment 40 can be activated because in neutral position II, the finger 105 is situated outside of the effective range of the safety barrel 41. The slide 101 does not block the activation of the safety equipment 40. The safety equipment 40 can be adjusted from "firing" position to "secured" position.

In order to correct the dysfunction, the breech block 3 is manually pulled back (fully loaded). During the process of fully loading, the release lever 53 is also activated and the rear lever arm 23 including the sear arm 31 moves upward out of the housing profile into the moving range of the breech block 3. The process of fully loading is also possible in the "secured" position of the safety equipment 40 because the slide 101 including the finger 105 in neutral position II is situated outside the effective range of the safety equipment 40. Also the lowering movement which the safety barrel exerts on the rear lever arm 23 during the process of fully loading is not obstructed.

After the process of fully loading, the sear catch 33 of the breech block 3 once again rests against the sear arm 31 of the slide stop 21, after first having displaced the slide 101 engaging at the rear face surface 103 into the safety position I in the slide stop 21. The finger 105 (shown in its safety position in dashed fashion in FIG. 5) is situated in the effective range of the safety equipment 40. The weapon is immediately in secured condition.

Now all required operations can be performed in the front area of the weapon without running the risk that the breech block 3 will be released through accidental activation of the trigger 9.

According to one example, by means of the slide 101, which can be adjusted relative to the sear arm 31 and which has a finger 105 engaging at the safety equipment 40, the following is provided: On the one hand, the weapon can be fully loaded even in secured position, because the slide 101 having the finger 105 is situated in the effective range of the safety equipment 40 only if the breech block 3 including its sear catch 33 has moved the rear face surface 103 of the slide 101 so far into the slide stop 21 that it closes flush with the rear face surface of the sear arm 31, and the sear catch 33 rests against the sear arm 31. On the other hand, the weapon can be secured in any condition, even if the breech block 3 is located in front of the handle and the rear lever arm 23 is lowered into the handle 2 because the slide 101 in neutral position II runs outside of the effective range of the safety equipment 40.

Figure 2:
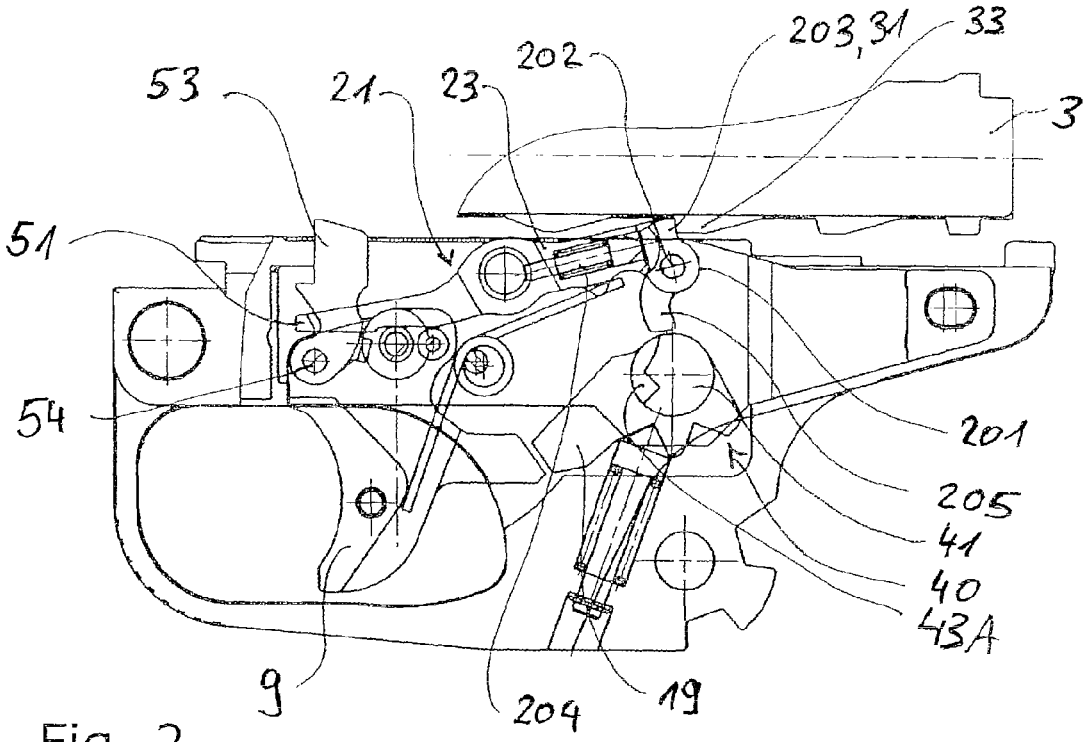
FIG. 2 a lateral view of a handle having a second example of the invention-based trigger device in which the safety element is designed in the form of a pivoted lever, wherein the slide stop is in arresting position having a blocked breech block and the safety equipment is in "secure" position A.
Figure 3:
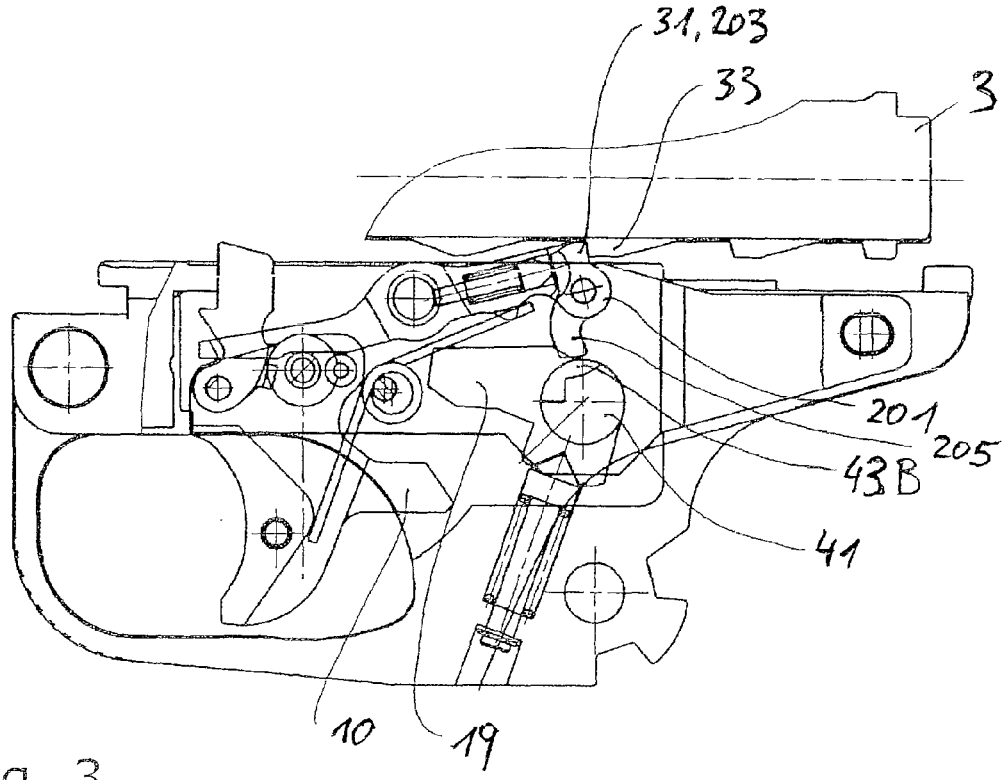
FIG. 3 the trigger device of FIG. 2 in which the safety equipment is in "firing" position B.

In a second example shown in FIGS. 2 though 7, the slide 101 has been substituted with a two-armed pivoted lever 201, which is located at a swivel axis 202 in the rear lever arm 23 running lateral to the bore axis 5. In one example, the first lever arm is shorter than the second lever arm and wherein ratio of the first lever arm length to the second lever arm length comprises about 1:2 to about 1:3 and the swivel axis 202 runs through a center of gravity of the pivot lever. At the same time, an upper lever arm 203 of the pivoted lever 201 forms the actuator by means of its rear face surface. At said actuator, the sear catch 33, with the breech block 3 resting against the sear arm, moves the pivoted lever 201 against the force of a spring arrangement 204 into secured position so that a lower lever arm 205 of the pivoted lever 201 moves as a locking element into the effective range of the safety equipment 40 (see FIGS. 2 and 3). In this position, the upper pivoted lever arm 203 submerges completely in the profile of the sear arm 31.

If the breech block 3 including the sear catch 33 does not rest against the sear arm 31, the pivoted lever 201 under the influence of the spring arrangement 204 accepts neutral position, in which the lower lever arm 205 lies outside of the effective range of the safety equipment 40, and the upper lever arm 203 protrudes partially out of the rear profile of the sear arm (FIGS. 4-7).

The functionality of this safety equipment is analogous to the safety equipment described in the context of the first example. However, the pivoted lever 201 is able to realize extremely short adjustment travels of the upper lever arm 203, because the lower lever arm 205 is designed longer than the upper lever arm 203. In the process, the shorter swivel travel of the upper lever arm 203 causes the longer swivel travel of the lower lever arm 205.

Figure 8:
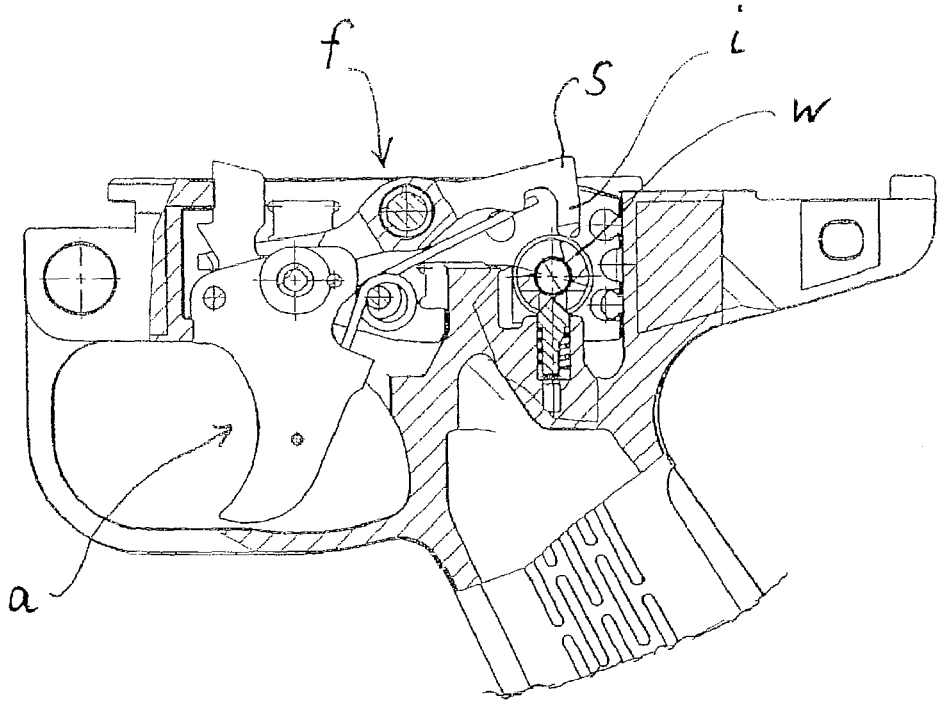
Fig. 8 PRIOR ART
FIG. 8 a cross-section of a customary trigger device in which a safety barrel is in "secured" position.
Figure 9:
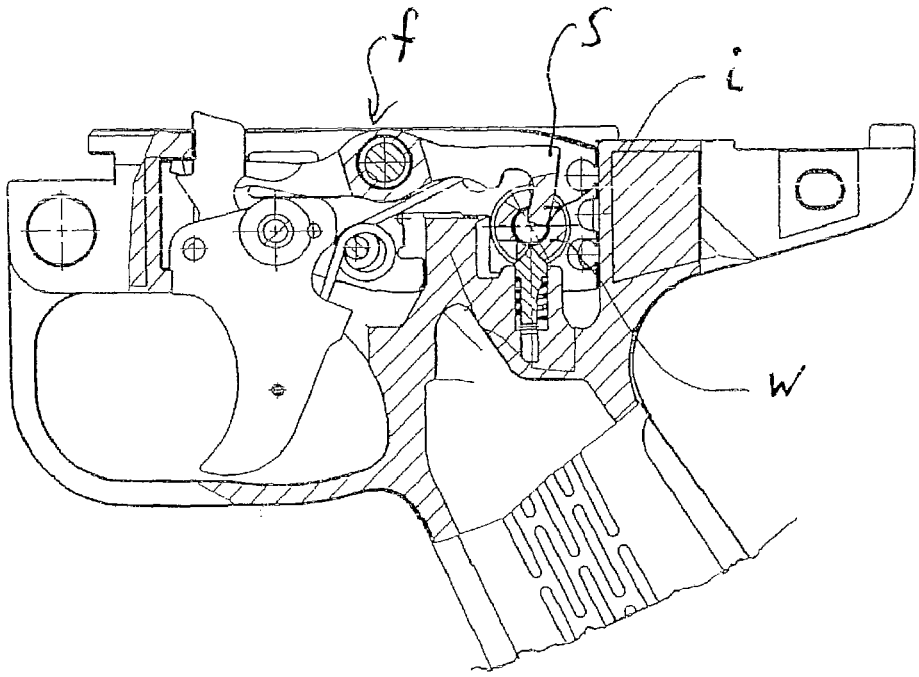
Fig. 9 PRIOR ART
FIG. 9 the trigger device from FIG. 8 in which the slide stop is shown to be jammed via its safety lug in the safety barrel.

The adjustment travel can become so short that the overlap with the sear catch 33 of the retracting breech block 3 extents backward only minimally longer than the slide stop (f) without pivoted lever 21, as shown in FIGS. 8 and 9. As a result, the breech arrangement according to FIGS. 2-7 can be exchanged with the breech arrangement shown in FIGS. 8 and 9 without having to make further adjustments. In practical terms it is only required to exchange the handle.

In the examples described above, the safety equipment is designed as twistable safety barrel 41 including the respective recesses 43. There are other examples in which the safety equipment is designed as a sliding lock in which a respective safety profile is designed lateral or parallel to the bore axis 5. Such a sliding lock has respective safety profiles including recesses and effective ranges, interacting with the safety element (for example, a slide 101 or a pivoted lever 201) arranged at the slide stop 21, analogous to the described safety barrel 41. Such a sliding lock can also be connected directly to a respective actuator or actuating-drive which controls the weapon in a weapon station. There are also examples that provide separate interfaces at which such actuators or actuating-drives are arranged.

As described above, the examples provide an improved catch lever. For example, the catch lever may include a safety element which, in relative position to the catch lever, can be adjusted between neutral position and secured position.

The safety element accepts its secured position if the breech block engages or attaches to the catch lever and the breech block exerts operating force on the safety element in forward direction (and adjusting to the secured position). In this position (the secured position), the safety element engages to the safety equipment, which simultaneously accepts its secured position and fixes the catch lever at its arresting position.

However, in other respects, the safety element is in neutral position (II) and releases the catch lever, independent of the position of the safety equipment.

In this solution, the functions of "arresting the breech block including the catch lever" and the actual safety function "fixing of the catch lever in arresting position" are constructively independent of each other, so that each component or structural element (in this case: the catch lever and safety element) can be ideally designed and constructed for their respective task.

The catch lever can be constructed robust and sturdy for the extreme stress to which it is exposed during interactions with the breech block. The safety element, on the other hand, is not exposed to extreme mechanical stress by the breech block. It has to be especially designed to be reliable in its interactions with the safety equipment.

At the same time, these arrangements allow for activation of the safety equipment in any functional condition of the weapon, without involving the danger that structural elements and the remaining safety equipment collide with one another.

Moreover, malfunction of the safety element does not affect the catch function of the sturdy sear arm at the catch lever. This means that there is minimal risk of uncontrolled shooting without activating the trigger.

Finally is it possible to fully load a weapon having such a catch lever even in secured position and the safety equipment of the weapon can be activated in any functional condition.

The second example embodiment increases functional safety in that it is guaranteed by, for example, a spring that the adjustable safety element accepts neutral position (because of resilience) or, under the impact of the breech block against spring load, takes on a secured position. In this way it is avoided that the function is possibly influenced by intermediate positions.

According to some examples, the safety element 101 or 201 is located in the area of the sear arm 31, which is constructed at the catch lever 21 and engages in the arresting position at the breech block. Such a sear arm 31 is especially suitable to engage in sturdy fashion at the breech block. Because of the fact that the safety element is arranged in this area, the breech block can have an effect on adjusting the safety element 101 or 201 into a secured position in the same way in which it can allow the sear arm or catch lever to be arrested.

In some examples, the safety element has an actuator that interacts with the breech block and by means of which it can be adjusted into its secured position. The safety element of such examples also has a locking element engaging at the safety equipment. Thus, actuator and locking element can be designed and arranged in a suitable way to meet the requirements for the respective functions.

In other examples, the functional security of the safety element is increased again by reducing the stress of the safety element. This can be achieved if the actuator having a snuggly fitting breech block is situated inside the sear arm profile. At the same time, the blocking function or arresting function at the breech block is performed exclusively by means of the sear arm. The safety element is not exposed to additional stress and, in particular, does not accept any stress exerted by the breech block spring via the breech block on the catch lever or sear arm.

According to an example, the safety element is in the form of a slide that allows the safety element to be arranged in the catch lever in reliable and protected fashion. Preferably, the sliding direction proceeds in the direction of movement of the breech block, keeping the stress level of the safety element when activating the breech block as low as possible.

In certain implementations, the safety element is designed as pivoted lever. The swivel axis, according to some examples, runs transverse to the running direction of the breech block. Consequently, the actuating direction of the pivoted lever also corresponds to the running direction of the breech block.

The two-armed design of a pivoted lever allows that the actuating direction (of the overrunning breech block) can also be diverted to a different locking direction of the second lever arm. For this purpose, the two lever arms can be placed at an angle. In this way, certain constructive basic conditions specified through the safety equipment can be flexibly incorporated.

If the lever arms are different in length, adjustment travel and locking travel can be of different length. In particular, if the first lever arm having the actuator is shorter than the second lever arm having the locking element, the adjustment travel can be comparatively short and, through the respective choice of leverage, the required locking travel can be long enough to provide sufficient travel to leave or enter the effective range of the safety equipment. As a result, the locking element can have the appropriate size and sturdiness with regard to the required active surface and mechanical stress.

If the swivel axis runs through the center of the pivoted lever, the pivoted lever is dynamically balanced, i.e., lateral accelerations exerted on the weapon cannot interfere with the secured position of the pivoted lever.

The arrangement of the active surface at the locking element or respective counter-surface at the safety equipment relevant for the locking effect may further increase the locking effect. In certain examples, a self-restriction provides that—even in cases of extreme stress between the sear arm and locking effect—the active surface of the locking element and the counter-surface of the safety equipment can divert from each other and disrupt the safety function. Such stress can occur, for example, in cases of extreme dynamic stress (impacts) on the weapon or if the trigger should exert extreme force on the slide stop against the locking effect, for example, in case of a power-operated activation of the trigger against the safety equipment.

In some examples, the trigger device includes an invention-based slide stop. In further examples, the invention-based trigger device can be exchanged with a conventional handle without the safety functions listed. If, the handle is equipped with one or several interfaces by means of which the trigger or safety equipment can be connected to an actuator, such a weapon can be easily used in a so-called weapon station.

Some examples may include a slide stop, a trigger device, or a handle, all of which are described herein.

Although certain apparatus constructed in accordance with the teachings of the invention have been described herein, the scope of coverage of this patent is not limited thereto. On the contrary, this patent covers every apparatus, method and article of manufacture fairly falling within the scope of the appended claims either literally or under the doctrine of equivalents.

The invention claimed is:

1. A firearm assembly for use in a firearm including a breech block, the firearm assembly comprising:

safety equipment;

a slide stop, wherein the slide stop is adjustable between an arresting position that locks a breech block and a position that does not lock the breech block; and a safety element adjustable relative to the slide stop between a neutral position and secured position, wherein in the secured position if the breech block exerts an operating force on the safety element and the safety element engages the safety equipment, the safety element fixes the slide stop in its arresting position, wherein the safety element is adjusted against spring force from the neutral position to the secured position.

2. A firearm assembly as defined in claims 1, wherein the safety element includes:

an actuator adapted to be carried by the breech block when the breech block is moving in a forward direction and, as a result, the safety element can be adjusted into the secured position; and a locking element located in an effective range of the safety equipment if the safety element is in the secured position.

3. A firearm assembly as defined in claim 2, wherein the safety element is arranged in an area of a sear arm and engaging the sear arm in its arresting position at the breech block.

4. A firearm assembly as defined in claim 3, in which the actuator is located inside a profile of the sear arm.

5. A firearm assembly as defined in claim 4, wherein the safety element includes a slide and in which a sliding direction of the safety element corresponds to a running direction of the breech block.

6. A firearm assembly as defined in claim 4, wherein the safety element includes a pivot lever having a swivel axis running lateral to a running direction of the breech block and which is pivotable in the slide stop.

7. A firearm assembly as defined in claim 6, wherein the pivot lever includes a two-armed configuration in which a first lever arm comprises the actuator and a second lever arm comprises the locking element.

8. A firearm assembly as defined in claim 7, wherein the first lever arm is shorter than the second lever arm and wherein ratio of the first lever arm length to the second lever arm length comprises about 1:2 to about 1:3.

9. A firearm assembly as defined in claim 7, wherein a swivel axis runs through a center of gravity of the pivot lever.

10. A firearm assembly as defined in claim 9, wherein the locking element including an effective surface engages in a self-restricting fashion at a respective counter surface of the safety equipment.

11. A firearm assembly as defined in claim 10, having at least one interface through which the trigger or safety equipment can be connected to an actuator for the purpose of activation.

12. A firearm comprising:

a breech block safety equipment;

a slide stop, wherein the slide stop is adjustable between an arresting position that locks the breech block and a position that does not lock the breech block; and a safety element adjustable relative to the slide stop between a neutral position and secured position, wherein in the secured position if the breech block exerts an operating force on the safety element and the safety element engages the safety equipment, the safety element fixes the slide stop in its arresting position, wherein the safety element is adjusted against spring force from the neutral position to the secured position.

13. A firearm as defined in claims 12, wherein the safety element includes:

an actuator adapted to be carried by the breech block when the breech block is moving in a forward direction and, as a result, the safety element can be adjusted into the secured position; and a locking element located in an effective range of the safety equipment if the safety element is in the secured position.

14. A firearm as defined in claim 13, wherein the safety element is arranged in an area of a sear arm and engaging the sear arm in its arresting position at the breech block.

15. A firearm as defined in claim 14, wherein the safety element includes a pivot lever that is located at a swivel axis running lateral to a running direction of the breech block and which can be swiveled in the slide stop.

16. A firearm as defined in claim 15, wherein the pivot lever includes a two-armed configuration in which a first lever arm comprises the actuator and a second lever arm comprises the locking element.

17. A firearm assembly as defined in claim 16, wherein the first lever arm is shorter than the second lever arm and wherein ratio of the first lever arm length to the second lever arm length comprises about 1:2 to about 1:3.

18. A firearm as defined in claim 12, wherein the firearm comprises an automatic weapon.

* * * * *

UNITED STATES PATENT AND TRADEMARK OFFICE

CERTIFICATE OF CORRECTION

PATENT NO. : 7,802,511 B2
APPLICATION NO. : 12/196965
DATED : September 28, 2010
INVENTOR(S) : Doll et al.

It is certified that error appears in the above-identified patent and that said Letters Patent is hereby corrected as shown below:

Title Page, Item (54) and at Column 1, lines 1 and 2, Title should read:

SLIDE STOP, TRIGGER DEVICE AND HANDLE FOR A WEAPON

Signed and Sealed this
Thirty-first Day of July, 2012

David J. Kappos

David J. Kappos
*Director of the United States Patent and Trademark Office*